US009655393B2

(12) United States Patent
Mathews et al.

(10) Patent No.: US 9,655,393 B2
(45) Date of Patent: May 23, 2017

(54) LAYERED STRUCTURAL FIRE GLOVE

(71) Applicant: Ansell Limited, Richmond (AU)

(72) Inventors: Marc Christopher Mathews, Greenville, SC (US); Lee Khommanyvong, Rockwell City, IA (US); Louis Orotelli, Township of Washington, NJ (US); Carrie Lirae Merck, Clemson, SC (US)

(73) Assignee: Ansell Limited, Victoria (AU)

( * ) Notice: Subject to any disclaimer, the term of this patent is extended or adjusted under 35 U.S.C. 154(b) by 234 days.

(21) Appl. No.: 14/532,158

(22) Filed: Nov. 4, 2014

(65) Prior Publication Data

US 2015/0121598 A1 May 7, 2015

Related U.S. Application Data

(60) Provisional application No. 61/900,024, filed on Nov. 5, 2013.

(51) Int. Cl.
*A41D 19/00* (2006.01)
*A41D 19/015* (2006.01)

(52) U.S. Cl.
CPC ..... *A41D 19/01529* (2013.01); *A41D 19/001* (2013.01)

(58) Field of Classification Search
CPC ..... A41D 19/00; A41D 19/002; A41D 13/08; A41D 19/02; A41D 19/0006
USPC ..... 2/159, 16, 160, 169, 164
See application file for complete search history.

(56) References Cited

U.S. PATENT DOCUMENTS

| | | | | |
|---|---|---|---|---|
| 204,199 | A | 5/1878 | Chow | |
| 1,010,199 | A | 11/1911 | Stedman | |
| 1,250,150 | A | 12/1917 | Bois | |
| 1,424,639 | A | 8/1922 | Augustine | |
| 4,471,495 | A | 9/1984 | Kruse et al. | |
| 4,679,257 | A * | 7/1987 | Town | A41D 19/0006 2/159 |
| 4,809,365 | A | 3/1989 | Chen et al. | |
| 4,876,747 | A | 10/1989 | Coffey et al. | |
| 5,349,705 | A | 9/1994 | Ragan | |
| 5,579,539 | A | 12/1996 | Flick | |
| 5,598,582 | A | 2/1997 | Andrews et al. | |
| 6,061,833 | A | 5/2000 | Smith et al. | |

(Continued)

FOREIGN PATENT DOCUMENTS

| | | |
|---|---|---|
| CN | 2515984 Y | 10/2002 |
| DE | 20301959 U1 | 5/2003 |

(Continued)

OTHER PUBLICATIONS

International Search Report and Written Opinion mailed Apr. 18, 2013 for PCT Application No. PCT/US2012/069743.

(Continued)

*Primary Examiner* — Tejash Patel
(74) *Attorney, Agent, or Firm* — Moser Taboada

(57) ABSTRACT

A flexible, multi-layer glove, including a liner, a glove shell having at least one of a knitted fabric or a flame-treated leather; and/or a floating barrier layer, that includes a plurality of attachment tabs, disposed between the glove shell and the liner, wherein the plurality of attachment tabs attach the barrier layer to the liner and to the glove shell and/or a floating insulation layer is disclosed.

16 Claims, 7 Drawing Sheets

(56) References Cited

U.S. PATENT DOCUMENTS

| | | | | |
|---|---|---|---|---|
| 7,007,307 | B2 | 3/2006 | Takeuchi | |
| 7,275,267 | B2 | 10/2007 | Thiruppathi | |
| 7,284,283 | B2 * | 10/2007 | Mack | A41D 27/245 2/16 |
| 7,434,422 | B2 | 10/2008 | Narasimhan et al. | |
| 7,478,440 | B2 | 1/2009 | Dolenak | |
| 7,665,155 | B2 | 2/2010 | Grilliot et al. | |
| 7,761,931 | B2 | 7/2010 | Schrodl | |
| 7,937,773 | B1 | 5/2011 | Kleinert | |
| 2007/0061942 | A1 | 3/2007 | Schroedl | |
| 2007/0083979 | A1 | 4/2007 | Daniels | |
| 2008/0201823 | A1 | 8/2008 | Jaeger | |
| 2009/0183296 | A1 | 7/2009 | Hardee et al. | |
| 2010/0071114 | A1 | 3/2010 | Jaeger | |
| 2010/0275341 | A1 | 11/2010 | Sweeney et al. | |
| 2013/0152262 | A1 | 6/2013 | Bedetti et al. | |

FOREIGN PATENT DOCUMENTS

| | | | |
|---|---|---|---|
| EP | 0724848 | A1 | 8/1996 |
| EP | 0724848 | B1 | 9/1998 |
| EP | 0874668 | B1 | 8/2000 |
| JP | H08158122 | A | 6/1996 |
| RU | 2295269 | C1 | 3/2007 |
| RU | 92769 | U1 | 4/2010 |
| RU | 2010120705 | A | 11/2011 |
| RU | 2454907 | C2 | 7/2012 |
| SU | 1369661 | A3 | 1/1988 |
| WO | WO-2010037773 | A1 | 4/2010 |

OTHER PUBLICATIONS

International Preliminary Report on Patentability and Written Opinion mailed Jun. 17, 2014 for PCT Application No. PCT/US2012/069743.

International Preliminary Report on Patentability and Written Opinion mailed Jan. 30, 2015 for PCT Application No. PCT/AU2014/001018.

PCT Search Report and Written Opinion, PCT/US2012/069743, 7 pages, Date of mailing Apr. 18, 2013.

PCT International Preliminary Report on Patentability, PCT/US2012/069743, 5 pages, Date of issuance Jun. 17, 2014.

* cited by examiner

LAYERED STRUCTURAL FIRE GLOVE

CROSS-REFERENCE TO RELATED APPLICATION

This application claims the benefit of priority under 35 U.S.C. 119(e) to U.S. Provisional Application Ser. No. 61/900,024, filed Nov. 5, 2013, which is incorporated by reference in its entirety.

BACKGROUND

Field of the Invention

Embodiments of the present invention generally relate to gloves and, more particularly, to multilayered gloves comprising at least one floating layer, imparting flexibility and providing enhanced dexterity in selected regions of the gloves.

Description of the Related Art

Gloves are used in many industrial and household settings to protect the hands of users. Many gloves are designed to embody specific properties for specific applications, for example, cut resistant yarns in gloves for use by those who use knives, saws, and the like. Additionally, firefighters, in particular, have multiple needs. For example, firefighting presents many different types of hazards against which firefighters must be protected. Firefighters encounter extreme heat, direct contact with fire and flash-flames, blood-borne pathogens, chemicals, water, steam, and the like. Furthermore, gloves used by firefighters must protect against impacts, punctures, and cuts. Therefore, adequate protection of the hands is paramount and, accordingly, a firefighter's glove must offer resistance against these hazards.

Because of these extreme safety requirements, thick, heavy-duty gloves are the standard for firefighting, which are very bulky, including inflexible shells and insulation, and are formed from cut-and-sewn manufacturing processes. However, as firefighting technologies evolve, firefighters now operate small, electronic controls, gas sensors, and the like, some having dimensions as small as ⅜ inch, as well as flashlights, dead-bolt locks, knobs, etc. Moreover, firefighters grasp the larger typical tools used in firefighting, such as hoselines and nozzles, ladder rungs, halligan tools, personal escape ropes, and the like. Therefore, it behooves firefighters to have gloves permitting high dexterity, including finger dexterity and palm dexterity, and excellent grip properties for grasping and controlling objects with strength in order to perform duties quickly and safely while exerting a high amount of force onto heavy or light objects while wearing the glove.

In addition, firefighters don and doff gloves often, particularly while the gloves are wet, therefore, doing so easily and quickly is desirable. Moreover, the gloves must maintain softness and pliability after withstanding many usage cycles, i.e., hot-cold, wet-dry during service as well as during laundering and decontamination, without the loss of softness and pliability. In sum, gloves that protect the hands of firefighters against multiple and varied hazards without compromising movement and dexterity would be desirable. Designing gloves for such applications can be challenging with the balance of these requirements in view.

To date, there is no durable, heat- and flame-resistant firefighter's glove that is highly dexterous and flexible that is easily donned and doffed while wet. It would therefore be a significant advance in the art to provide a glove addressing these previously unmet needs.

SUMMARY

A flexible, multi-layer glove, including a flame-resistant liner, a flame-resistant glove shell having at least one of a knitted fabric or a flame-treated leather; and a barrier layer, that includes a plurality of attachment tabs, disposed between the flame-resistant glove shell and the flame-resistant liner, wherein the plurality of attachment tabs attach the barrier layer, disposed as a floating layer, to the liner and to the glove shell, substantially as shown in and/or described in connection with at least one of the figures, as set forth more completely in the claims, is disclosed. Various advantages, aspects, and novel features of the present disclosure, as well as details of an exemplary embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is to be understood that elements and features of one embodiment may be in other embodiments without further recitation and that, where possible, identical reference numerals have been used to indicate comparable elements that are common to the figures.

Figure 1A:
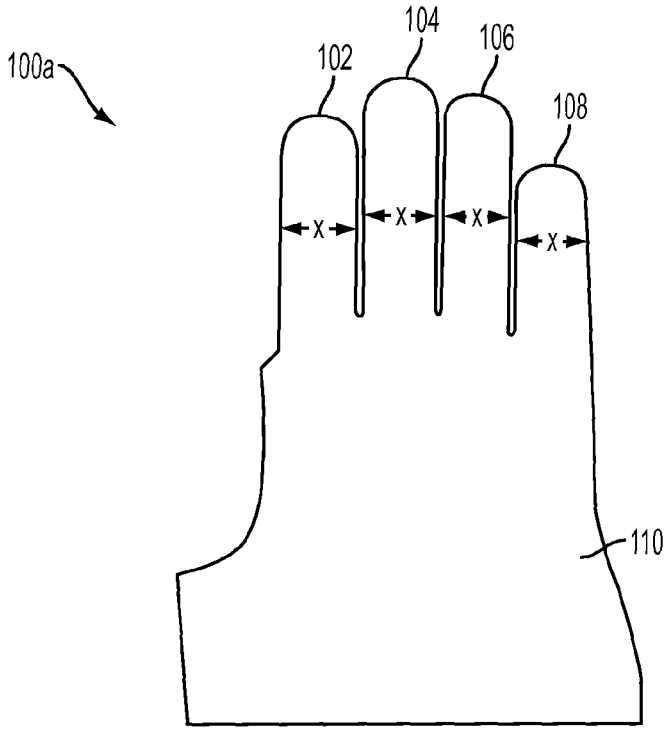
FIG. 1A depicts a plan view of a first glove layer, according to embodiments of the invention.

To facilitate understanding, identical reference numerals have been used, where possible, to designate comparable elements which are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present invention comprise a multi-layered glove capable of enhanced flexibility and dexterity while remaining thermally protective. Embodiments according to the invention include a liner, such as a knitted or woven liner, a heat- and/or flame-resistant glove shell, and at least one floating layer disposed between the liner and the glove shell. The floating layer comprises a layer that is, for example, not completely adhered or attached, whether with adhesives, glues, etc., or stitched or sewn, to one or more adjacent layers, such as the glove shell or the liner. The floating layer comprises, for example, a heat-, flame-, cut- or abrasion-resistant layer, and/or a moisture-barrier layer. Embodiments according to the invention include wherein the floating layer is on at least one of the palm side, the backhand side, or both. In at least one exemplary embodiment, the floating layer is in a shape of a glove and traverses all of the glove shell or the liner. At least one exemplary embodiment according to the invention comprises a flexible, multi-layer glove that is compliant and/or certified to at least one of NFPA 1971-99, NFPA, 1971-13, NFPA 1999, and/or NFPA 2012 standards.

Figure 1B:
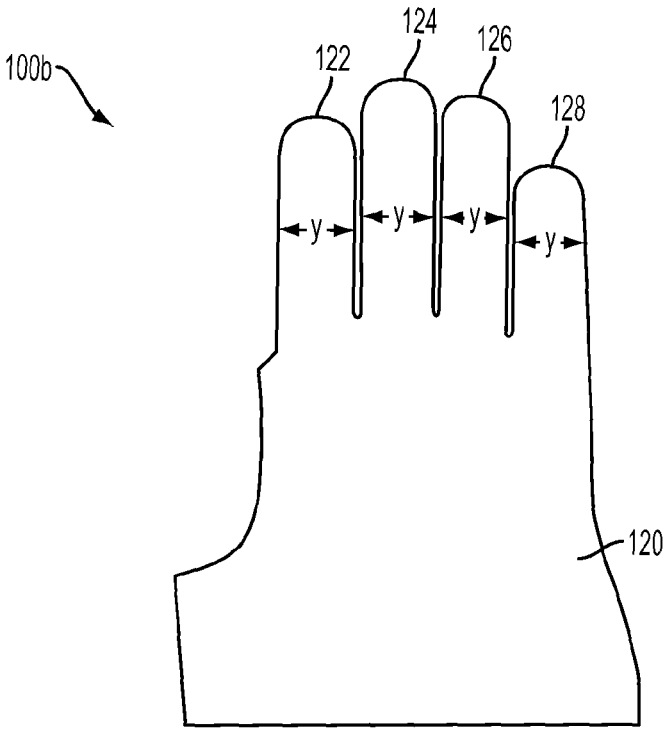
FIG. 1B depicts a plan view of a second glove layer, according to embodiments of the invention.

FIGS. 1A-1B depict two parts of a layer for a glove shell, according to embodiments of the invention. FIG. 1A depicts a plan view of a first glove layer 100*a*, according to embodiments of the invention. The first glove layer 100*a* comprises an index finger portion 102, a middle finger portion 104, a ring finger portion 106, a pinky finger portion 108, and a cuff portion 110. The first glove layer 100*a* comprises a knitted flexible, flame-resistant fabric, for example, a meta-aramid, such as a meta-aramid sold under the brand name NOMEX®. FIG. 1B depicts a plan view of a second glove layer 100*b*, according to embodiments of the invention. The second glove layer 100*b* comprises an index finger portion 122, a middle finger portion 124, a ring finger portion 126, a pinky finger portion 128, and a cuff portion 120. The second glove layer 100*b* comprises a knitted, flame-resistant fabric, such as an oxidized polyacrylonitrile (OPD) material, such as CARBONX® yarns. The second glove layer 100*b* may be disposed as a floating layer as discussed in greater detail below. The first glove layer 100*a* also comprises where the dimensions of the index finger portion 102, the middle finger portion 104, the ring finger portion 106, and the pinky finger portion 108, as denoted by "x", are larger than the corresponding dimensions "y" on the second glove layer 100*b*.

Figure 2A:
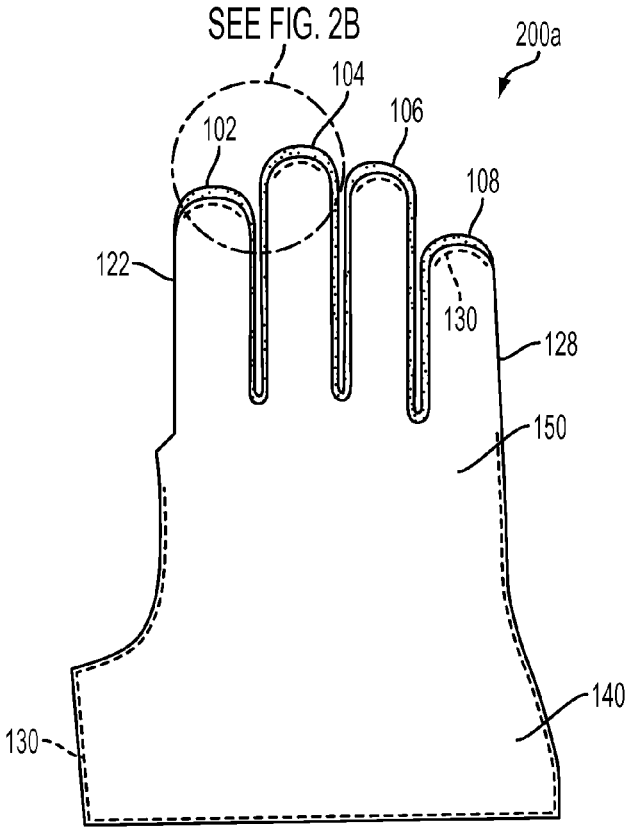
FIG. 2A depicts a composite layer for a glove shell, according to embodiments of the invention.
Figure 2B:
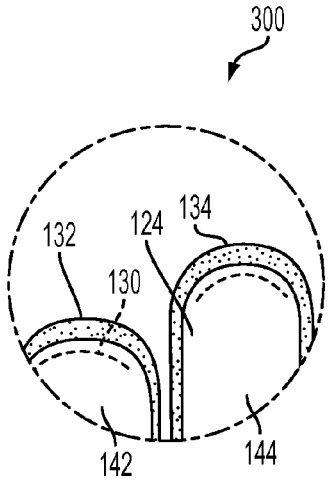
FIG. 2B is a close up view of the tips of the index and middle finger of FIG. 2A, according to embodiments of the invention.

FIGS. 2A-2B depict a plan view of the first glove layer 100*a* sewn onto the second glove layer 100*b*, forming a composite layer 200*a*; according to embodiments of the invention. FIG. 2A depicts a composite layer 200*a* for a glove shell, according to embodiments of the invention. In FIG. 2A, the composite layer 200*a* comprises the composite fingers, as well as a composite cuff layer 140 and composite upper portion 150. The second glove layer 100*b* is stitched onto the first glove layer 100*b* by a stitch 130. Embodiments of the invention comprise where the stitch 130 is a single stitch (as shown) double, or triple stitch (not shown).

FIG. 2B is a close up view 300 of the tips of the index and middle finger of FIG. 2A, according to embodiments of the invention. As described above, the second glove layer 100*b* is smaller than the first glove layer 100*a*, particularly on the finger tips. The second glove layer 100*b* comprises wherein the finger tips 142 and 144 are between 3-5 mm shorter than the corresponding finger tips 132 and 134. In at least one exemplary embodiment, the finger tips 142 and 144 are approximately 4 mm shorter than the corresponding finger tips 132 and 134 of the first glove layer 100*a* and second glove layer 100*b*. In practice, this difference may comprise any practical difference, for example, 1-10 mm. Similarly, the fingers 122, 124 (or any or all of the fingers) of the second glove layer 100*b* are less wide compared with the width of the fingers 102, 104 of the first glove layer 100*a*, and may be, as above, 2 mm to 10 mm, shorter.

Furthermore, the stitch 130 is not present around the entire periphery of the attached first glove layer 100*a* and second glove layer 100*b* that comprises the composite layer 200*a*, thereby forming a flexible, floating layer. Two composite layers 200*a* may be stitched together to form a shell, when a thumb portion is sewn therewith, as discussed below. In some exemplary embodiments of the invention, the two composite layers 200*a* are sewn together so that an interior surface of the shell comprises the oxidized polyacrylonitrile fibers and an exterior surface of the shell is the meta-aramid material. Because the second glove layer 100*b* is smaller than the first glove layer 100*a* for both halves of the two composite layers 200*a*, and stitched on less than 100% of its periphery, such as by stiches 130, the shell remains flexible during service, i.e., when a hand is clenched or closed.

Figure 3:
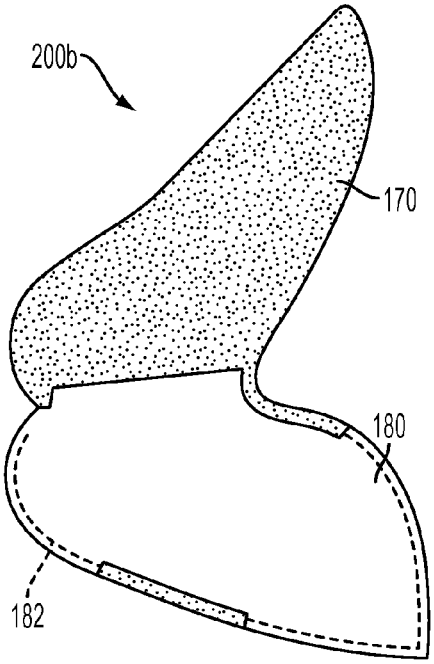
FIG. 3 depicts a thumb portion for a glove shell, according to embodiments of the invention.

FIG. 3 depicts a thumb portion 200*b* for a glove shell, according to embodiments of the invention. The thumb portion 200*b* comprises a first thumb piece 170 comprising a meta-aramid yarn, for example, NOMEX®, for flame-resistance and stretchability. The thumb portion 200*b* further comprises a second thumb piece 180 comprising a flame-resistant yarn, such as CARBONX®, which is sewn onto the first thumb piece 170 with stiches 182. The thumb portion 200*b* is adapted to be sewn onto the glove layer 200*a*, as discussed above, to form a glove shell. As depicted, the thumb portion 200*b*, when sewn with the two composite layers 200*a*, forms part of a shell keyhole thumb, as discussed below. The composite layer 200*a* or the thumb portion 200*b* may comprise flame-resistant treated cowhide leather, para-aramid, e.g., KEVLAR®, a meta-aramid, i.e., NOMEX®, an oxidized polyacrylonitrile fibers, and/or the like. Also, optionally, an additional layer may be disposed on the composite layer 200*a* or the thumb portion 200*b*, for example, an additional layer of NOMEX® or CARBONX® on a back side of the composite layer 200*a*.

Embodiments according to the invention also comprise floating layers on individual fingers, the thumb, the cuff, the backhand area, the palm, and/or any other region of a glove. Specifically, any region of the glove can have a floating layer, one that is not fully attached on its entire periphery, attached thereto. One such example is attaching a floating layer to the backhand side of an index finger, thereby protecting the back of the finger without impacting the dexterity of a "trigger" finger, such as might be used for operating certain firefighting equipment.

Figure 4:
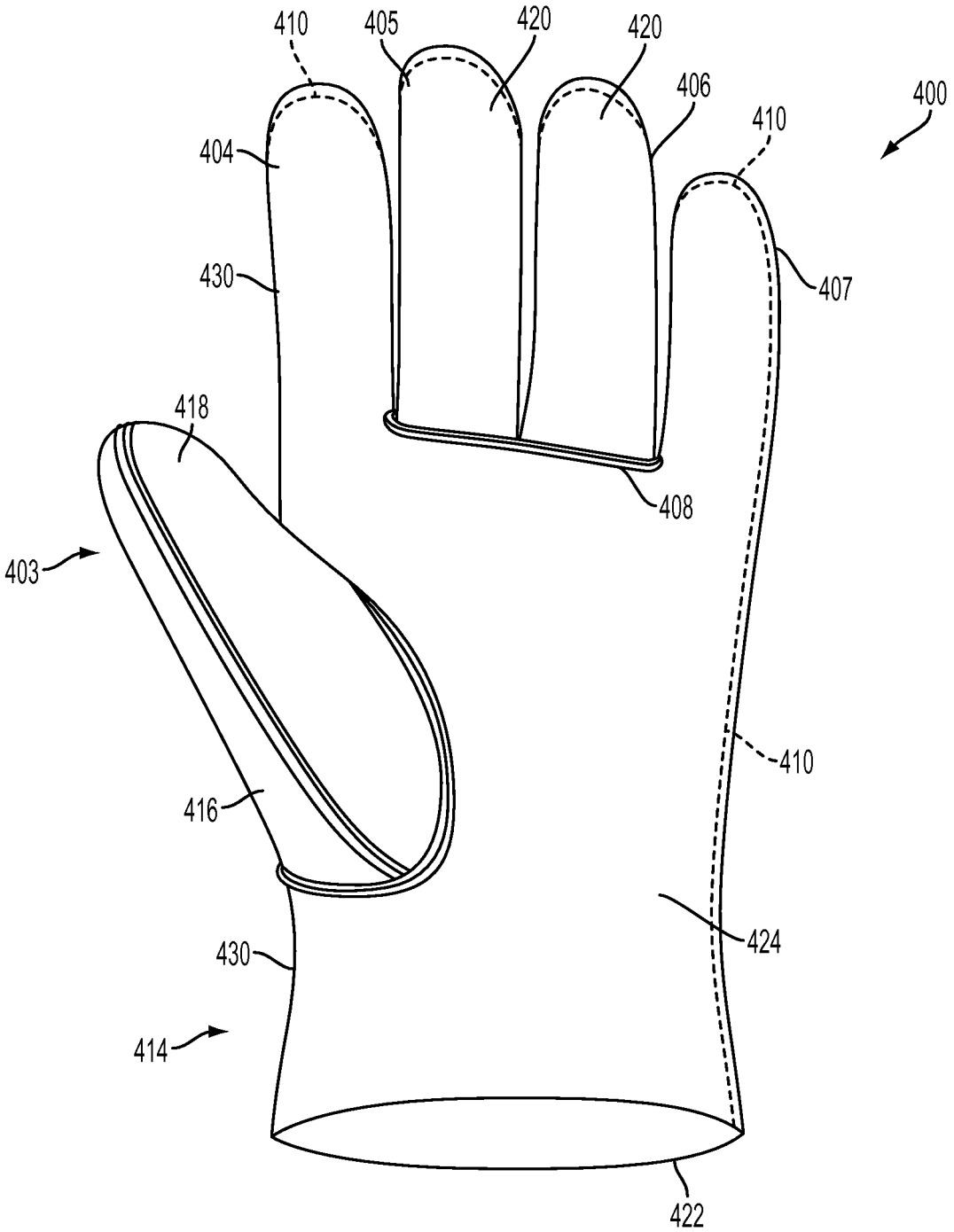
FIG. 4 depicts a liner, according to embodiments of the invention.

FIG. 4 depicts a liner 400, according to embodiments of the invention. The knitted liner 400 comprises a thumb 403, and fingers 404, 405, 406, and 407 and contacts the skin of a user when worn. The liner 400 comprises, for example, a knitted fabric that is subsequently cut and sewn in the shape of a glove. The liner 400 is comprised of a main piece 414, a finger piece 420, a first thumb piece 416, and a second thumb piece 418. Similarly to the keyhole thumb discussed above, the first thumb piece 416 and the second thumb piece 418 form the liner keyhole thumb 403. The main piece 414 comprises a palm side 424 and a back side 422 and is folded along a border 430 and is sewn at a border 410. The main piece 414 further comprises back side portions (not shown) of all fingers 404, 405, 406, and 407. The liner 400 further comprises front finger portions 420, which are sewn into the main piece 414 as a Gunn cut 408. The liner 400 comprises a cut-resistant yarn, for example, a para-aramid, such as a para-aramid sold under the KEVLAR® brand. The liner 100 may be knitted into the form of a glove by any conventional knitting process, typically using for example, 13-, 15-, or 18-gauge needles, and comprise various deniers of yarns or any suitable yarn. 18-gauge needles for knitting yarns having a denier of 221 or less are particularly flexible and therefore articles knitted therewith are comfortable to wearers. At least one exemplary embodiment of the invention includes wherein the liner 400 comprises a para-aramid, brushed interlock knit style.

In some embodiments, the liner may be knitted according to the knitted variable stitch dimension technology (KVSD) disclosed in commonly assigned U.S. Pat. No. 7,434,422, which is herein incorporated by reference in its entirety. The incorporation of the KVSD technology allows areas of selectively increased stitch density, providing additional protection in areas of the hand more prone to injury, such as the knuckles, without increasing the overall bulkiness of the glove or detracting from its flexibility. The liner may also comprise the seamless knit technology according to the co-pending, commonly assigned U.S. Publ. No. 2010/0275341, which is herein incorporated by reference in its entirety.

Liners in accordance with embodiments of the invention comprise many different yarns having different properties, such as flame-resistance, moisture-control, chemical resistance, flexibility, impact-resistance, abrasion-resistance, and other desirable properties imparted by various yarns and/or structures. For example, liners in accordance with embodiments of the invention comprise yarns such as, but not limited to, cotton, rayon, merino wool, steel wire, glass fibers, filaments, ultra-high molecular weight polyethylenes, meta-aramids, para-aramids, aromatic polyesters, nylons, DYNEEMA®, SPECTRA®, NOMEX®, TWARON®, KEVLAR®, VECTRAN®, and the like or any blend of the fibers and materials. Some yarns, such as modacrylic yarns, oxidized-polyacrylonitrile (O-PAN), such as PANOX® and ARSELON®, provide enhanced heat-resistance. Some yarns may be used for cut-resistance, such as steel wire, glass fibers, filaments, ultra-high molecular weight polyethylene, NOMEX®, TWARON®, KEVLAR®, and DYNEEMA®. The liner comprises, for example, a yarn exhibiting desired properties, such as heat- and flame-resistance and flexibility. Optionally, a second yarn exhibiting second desired properties, for example, cut-resistance is incorporated within the liner. Embodiments of the invention further include a liner having regions having different physical properties. For example, a liner comprises a palm region knitted with a yarn and a backhand region knitted with a different yarn.

Embodiments according to the invention also comprise other yarns to provide dexterity and fit properties, such as stretchable yarns, for example, SPANDEX® and/or LYCRA®, and/or a stretchable NEOPRENE® yarn. At least one exemplary embodiment of the invention includes flame-resistant yarns disclosed in commonly-assigned U.S. Pat. No. 8,074,436, which is incorporated herein by reference Some yarns may be specified for two or more properties. For example, CARBONX® yarns may be used for areas of the liner requiring flame-resistance and where stretchability is not critical while a meta-aramid, for e.g., NOMEX®, yarns may be used for woven and/or knitted liners and/or glove shells where flame-resistance and stretchability are desired. Moreover, functionally, meta-aramid and/or para-aramid yarns can be used as threads to join layers of the glove. Any thread is optionally made of a self-extinguishing fiber, such as modacrylic fiber or an aromatic polyester, such as VECTRAN®, or blends of NOMEX®, VECTRAN®, modacrylic fibers, and the like.

Yarns capable of moisture management, such as STA-COOL® polyesters, HYDROTEC®, AQUARIUS®, and DRYENERGY®, may be included to withdraw moisture and perspiration for example, from the skin, providing comfort. Also, additional cut resistant layers may be plaited with a main body yarn. A cut-resistant layer comprises, as indicated above, steel wire, glass fibers, filaments, high-performance polyethylene (HPPE), ultra-high molecular weight polyethylene, nylons, NOMEX®, TWARON®, KEVLAR®, DYNEEMA®, SPECTRA®, VECTRAN®, and the like or any blend of the fibers or filaments of these materials. Any of the yarns may discussed above may comprise one or more yarns, such as can be created by ring spun, rotor spun, friction spun, braiding, and other processes for blending yarns.

Liners in accordance with embodiments of the invention may be knitted using automatic seamless glove knitting machines. Seamless glove knitting machines include, but are not limited to, models NSFG, SFG-1, and SWG by Shima Seiki Mfg., Ltd. Liners knitted with the courses running vertically may be knitted by the SWG (single whole garment) machine by Shima Seiki Mfg., Ltd.

Figure 5:
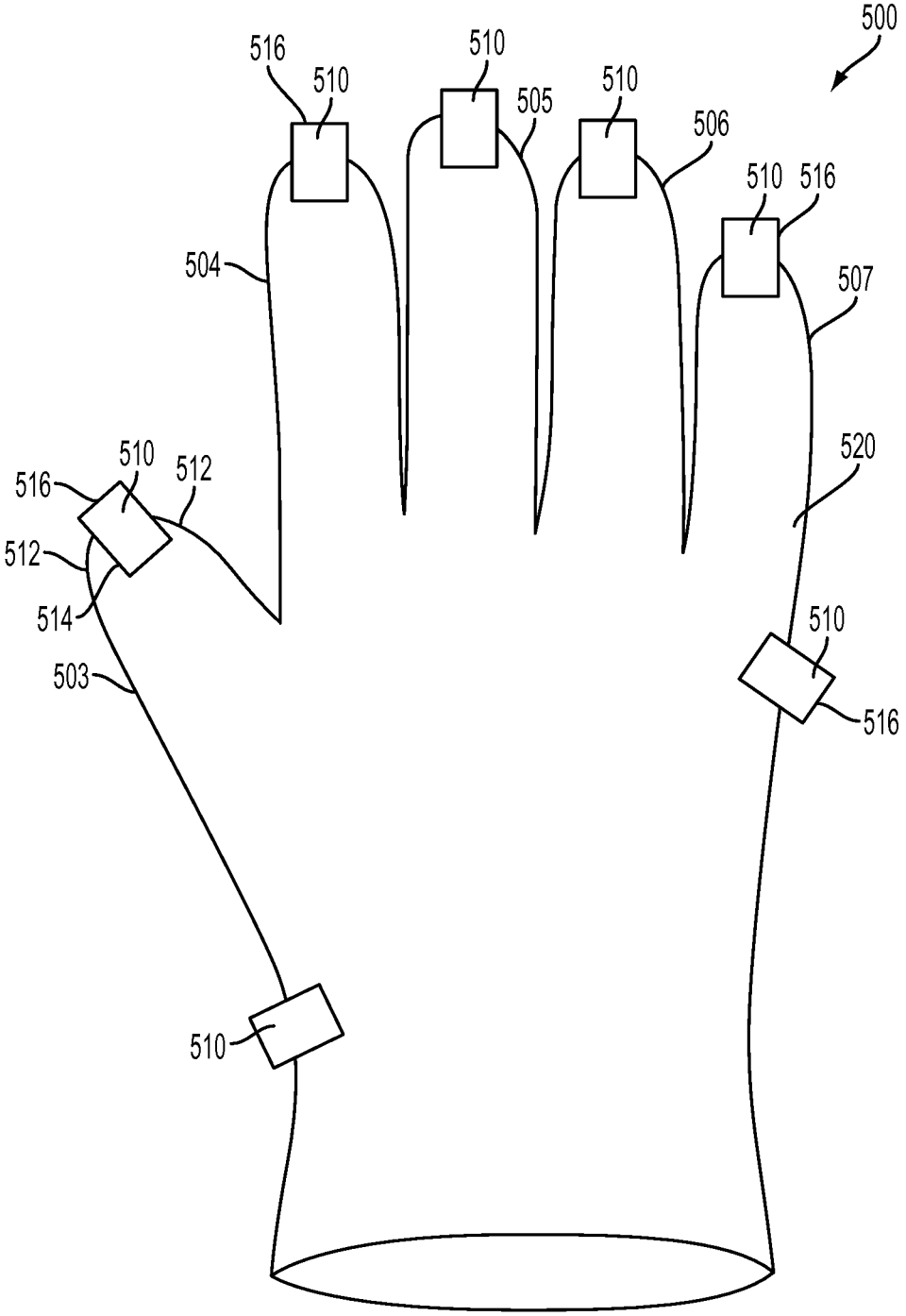
FIG. 5 depicts a perspective view of a barrier layer, according to embodiments of the invention.

FIG. 5 depicts a perspective view of a barrier layer 500, according to embodiments of the invention. The barrier layer 500 comprises a thumb 503, and fingers 504, 505, 506, and 507. The barrier layer 500 comprises, for example, a moisture barrier layer such as a breathable expanded polytetrafluoroethylene membrane or a polyurethane membrane, which may be configured as a floating layer that allows any glove made therewith to be additionally flexible and dextrous. For example, the barrier layer 500 comprises a plurality of attachment tabs 510. The plurality of attachment tabs 510 comprise, for example, a polyurethane film disposed on a polyester material. In at least one exemplary embodiment of the invention, the plurality of attachment tabs 510 are heat sensitive and soften at a temperature ranging from approximately 100-200° C. The moisture barrier layer 500 may comprise a polyurethane layer, such as a Porelle® brand membrane or an expanded polytetrafluoroethylene (ePTFE) membrane such as a GoreTex® brand membrane. The moisture barrier layer 500 is permanently bonded to the liner or shell by heating with heating irons, heated steel dies, convective heated air, or the like. The application of heat and/or pressure allows all areas of the liner to be permanently affixed to the moisture barrier layer without compromising the breathability of the moisture barrier layer.

The attachment tabs 510 traverse the border 512, for example, of the tip of the thumb 503, so that a first end 514 of the attachment tab 510 is adhered to an exterior surface 520 of the barrier layer 500 on the front side of the tip of the thumb 503 as well as the backside tip of the thumb 503. Also, a tip portion 516 of the attachment tab 510 does not contact any part of the barrier layer 500. The tip portions 516 of the plurality of attachment tabs 510 can then be sewn onto, for example, the liner 400 or the shell as discussed above. The barrier layer 500 further comprises a plurality of attachment tabs 510 on an interior surface (not shown) of the barrier layer 500. As discussed below, the barrier layer 500 has the plurality of attachment tabs 510 disposed on its exterior surface 520, is inverted, and a plurality of attachment tabs 510 on a second surface (not shown).

As discussed above, a flame-resistant glove that allows flexibility, tactility, and dexterity is important to firefighters. These properties can be achieved by using a floating layer. The barrier layer 500 is disposed between the liner 400 and the shell, although the barrier layer 500 is attached only by the plurality of the attachment tabs 510. Accordingly, the barrier layer 500 can "float," i.e., in many areas of a glove made therewith. In other words, the barrier layer 500 floats with respect to the liner 400 and the shell because it is not adhered to either the liner 400 and the shell completely. Accordingly, the floating barrier layer 500 cannot restrict any movement if the glove is flexed, clenched, and the like, except in those areas where it is attached, generally promoting flexibility of the glove. At least one exemplary embodiment according to the invention comprises a heat insulation layer including a first fabric, comprising OPD fibers, and a second fabric, comprising meta-aramid fibers, disposed between and attached to at least one of the glove shell and the liner in a backhand region, wherein the first fabric and the second fabric are sewn on less than 50% of its periphery, forming a floating composite layer sewn to at least one of the liner or the glove shell.

Figure 6:
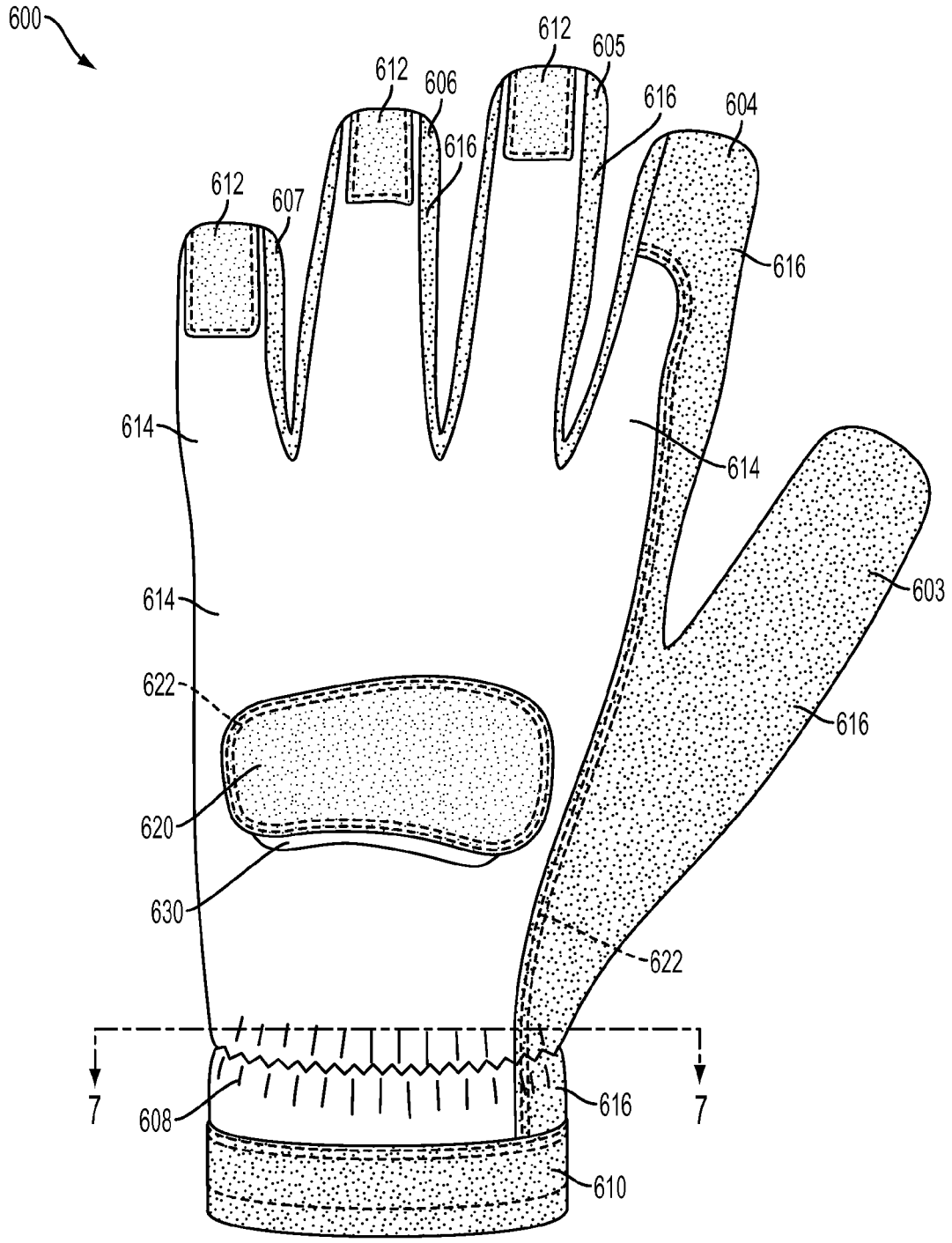
FIG. 6 depicts a plan backhand view of a glove, according to embodiments of the invention.

FIG. 6 depicts a plan backhand view of a glove 600, according to embodiments of the invention. The glove 600 comprises a thumb 603, an index finger 604, a middle finger 605, a ring finger 606, and a little finger 607. The glove 600 also comprises leather tips 612 disposed on the middle finger 605, the ring finger 606, and the little finger 607. The leather tips 612 may be disposed on the thumb 603 and the index finger 604, if desired (not shown). The glove 600 further comprises a crimped cuff 608 and a leather gauntlet cuff 610. The backhand region 614 comprises the composite layer, comprised of layers of the knitted oxidized polyacrylonitrile fibers and meta-aramid fibers, as discussed above. The glove 600 further comprises an exterior layer of leather 616. As shown, the exterior layer of leather 616 is disposed on the thumb 603 (front and back), and on the sides of the index finger 604, middle finger 605, ring finger 606, little finger 607 and crimped cuff 608 and is sewn onto the glove 600 with double stitch 622, which comprise, for example, a cut-resistant para-aramid yarn. In at least one exemplary embodiment according to the invention, the exterior layer of leather 616 comprises a full grain cowhide leather having a flame retardant treatment, as discussed herein. The glove 600 further comprises a leather backhand patch 620, sewn thereto with double stitch 622 and a reflective fabric 630 disposed at least partially under the leather backhand patch 620. The exterior layer of leather 616 is attached to the first glove layer 100*a*.

Figure 7:
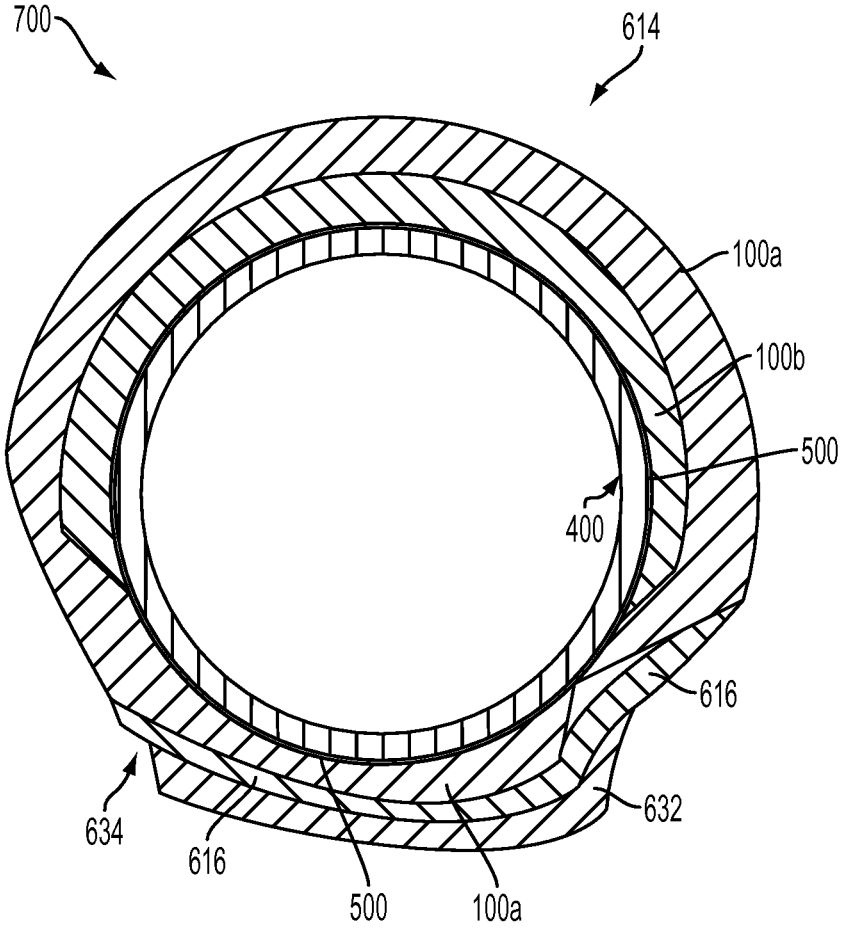
FIG. 7 depicts a cross sectional view taken along line 7-7 of the glove of FIG. 6, according to embodiments of the invention.

FIG. 7 depicts a cross-sectional view 700 taken along line 7-7 of the glove 600 of FIG. 6, according to embodiments of the invention. The cross-sectional view 700 shows the cross-section of the glove 600 in the crimped cuff 608 region. The backhand region 614 of the glove 600 is shown at the top of the cross-sectional view 700. The palmside region 634 of the glove 600 is shown at the bottom of the cross-sectional view 700. The liner 400, as discussed above, is shown and is the layer that would contact the skin of a wearer when the glove 600 is worn. The barrier layer 500 is attached to the liner 400. The liner 400 is a floating layer in the crimped cuff 608 area of the glove 600 because there are no attachment tabs in the crimped cuff 608. The barrier layer 500 is also adjacent to the second glove layer 100*b* on the backhand side 614 of the glove 600 while the barrier layer 500 is adjacent to the first glove layer 100*a* on the palm side 634 of the glove 600. Disposed on the layer of leather 616 is a cuff bar 632.

In some embodiments, different leathers are specified for various regions, according to embodiments of the invention. For example, the index finger of a glove optionally includes an additional finger patch disposed on top of a goatskin leather comprising the palmside and cow split leather on the backside of the index finger. In some embodiments, leather shells and reinforcing patches comprise various treatments and finishes. For example, a patch on a finger comprises a goatskin leather having a treatment, such as PITTARDS® WR100X treatment, imparting water resistance while maintaining breathability. In some embodiments, similarly, a patch is applied to the thumb and, for example, a crotch between the thumb and the index finger. Other patches may be overlaid onto the glove. For example, a patch is optionally overlaid on the pinky finger, extending from the palmside of the shell to the backhand side of the shell. Also, a patch optionally comprises a goatskin having a PITTARDS® Armotan finish, which improves the abrasion resistance of the leather. The Armotan treatment encases the fibril bundles of the leather with ceramic plates, which increase durability. Alternately or additionally, a patch may comprise a PITTARDS® Keratan treatment, which is a diamond etching surface treatment bonded to the leather, creating additional abrasion resistance, water resistance, and flexibility as well as grip. Embodiments according to the invention optionally include additional layers. For example, a third layer, comprising a shell, could comprise any of all of the above mentioned leathers. Furthermore, the glove 600 comprises a cuff bar disposed on a palm side of the glove as discussed below, as disclosed in commonly-assigned U.S. patent application Ser. No. 13/715,224, which is incorporated by reference in its entirety.

Embodiments of the invention further comprise a floating layer, for example, a knitted layer comprising a meta-aramid or OPD, disposed as a floating patch between the liner and the shell, for example, on the backhand region of the glove, and sewn onto either or both of the liner and the shell. The floating patch provides an insulative effect, such as insulation from heat, without being completely sewn or otherwise adhered to either or both of the liner or shell, such as might be done with stitching or adhesives. The reduction in stiffness provides a very flexible glove, resulting in enhanced comfort as well as allowing the user to grip more tightly onto tools. And, as noted above, where the glove has no localized stiffness, the application of pressure as is present during, for example, closure of the hand, causing compression of the layers of the glove, is lessened, and therefore the flashing of water into steam is eliminated or substantially reduced.

A glove shell, as described above, is also optionally pre-formed into a bent configuration. In other words, the glove shell is formed as if there is a hand within it that is partially bent at the knuckles, i.e., a partially clenched fist. A glove comprising a pre-bent glove shell requires less travel to clench to a closed fist. Because there is less compression when a glove or glove shell is pre-formed into a bent configuration, during clenching there is less stress on the glove and, therefore, the wearer will feel less heat because the glove will not be as tight to the skin. In other words, the gloves according to embodiments of the invention are expected to get wet during service, from both sweat and water used to extinguish fires, and, of course, firefighters will be exposed to high-temperature radiant, conductive, and/or convective heat flux and/or flames. Nonetheless, the amount of heat that the wearer feels can be substantially lessened. During use, when a hand is clenched, hot water within a loosely fitting glove, for example, because of a floating layer, prevents or lessens the water from flashing because of the increased pressure, which otherwise becomes steam capable of injuring the wearer. In other words, the hot water combined with the pressure created by compression forces, allows the water to become steam. Because embodiments of the present invention, via the floating layers as discussed herein and, separately, because of the pre-bent glove shell, lessen the amount of pressure within the glove during use, this condition is less likely to occur and will be less severe.

Figure 8:
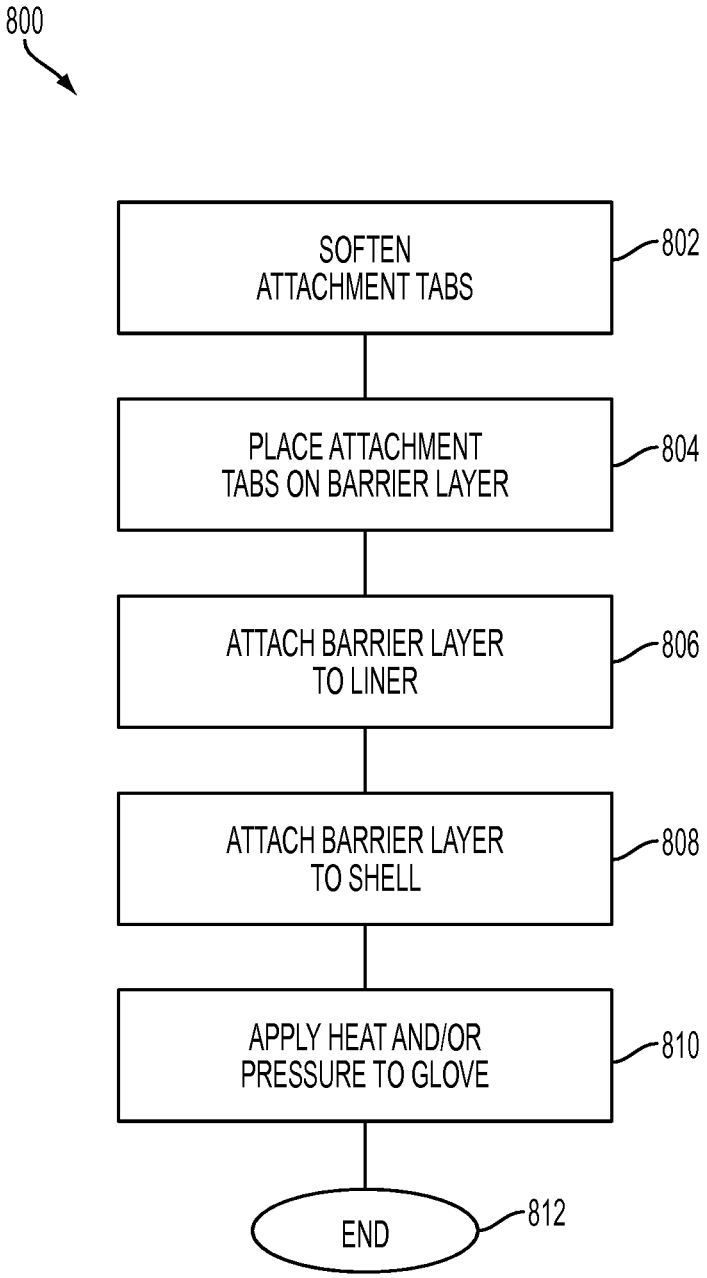
FIG. 8 depicts a method for manufacturing a glove, according to embodiments of the invention.

FIG. 8 depicts a method 800 for manufacturing a glove, according to embodiments of the invention. The method 800 starts at step 802, at which point a plurality of attachment tabs are softened. For example, the attachments tabs may be cut to a desired length, set on a suitable surface, such as paper, insulation paper, or the like, and heated until softened and/or tacky. Some embodiments of the invention comprises softening the attachments tabs with an iron at approximately 140-200° C. for approximately 5-10 seconds. Embodiments according to the invention comprise a softening step for some attachments tabs because some materials comprising the attachment tabs soften at a temperature in excess of a melting temperature of the material of the barrier layer. Therefore, so the barrier layer is not damaged, the attachment tabs may be softened before being disposed on the barrier layer and/or liner and/or shell.

The method 800 then proceeds to step 804 at which point the attachment tabs are applied to the barrier layer. As discussed above, the attachment tabs may be applied to one surface of the barrier layer, which is in the shape of a hand. If a plurality of attachment tabs are to be applied to an interior surface and an exterior surface, the barrier layer is inverted and another plurality of attachment tabs attached to the barrier layer, i.e., there is a plurality of attachments tabs on the tips of the fingers and/or thumb and/or other regions of both the interior surface and exterior surface of the barrier layer.

The method 800 next proceeds to step 806, at which point the barrier layer is attached to one of a shell or a liner. For example, the barrier layer may be attached to the liner and inverted over the liner. Next, at step 808, the barrier layer may be attached to the shell and the shell inverted over the liner and barrier layer. Alternately, the barrier layer may be attached first to the shell and then to the liner.

The method 800 next proceeds to step 810, at which point the heat and/or pressure is applied. For example, heat may be applied at approximately 100-115° C., generally lower than the softening temperature discussed above, for approximately 5-10 seconds at a pressure of, for example, 0.10-0.15 mPa, thereby forming a glove. Heat and pressure may be applied to one side of the glove at a time or to both sides simultaneously. Also, embodiments according to the invention include wherein heat and/or pressure are applied to, for example, the barrier layer and liner before the liner is inverted onto the liner or before the shell is inverted onto the liner and barrier layer. At step 812, the method 800 ends.

Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

While the foregoing is directed to embodiments of the present invention, other and further embodiments of the invention may be devised without departing from the basic scope thereof, and the scope thereof is determined by the claims that follow. Additionally, all features disclosed herein may be incorporated into any embodiment of the present invention. Additionally, all features disclosed herein may be incorporated into any embodiment of the present invention. For example, a floating layer comprising a barrier layer, such as a moisture control layer as described herein, attached on one or more of the liner (whether the liner comprises two or more layers, such as a plaited layer on a main layer) or shell and may be incorporated into any embodiment having a liner and/or a shell. Similarly, a floating layer may comprise two layers sewn together on less than all of the periphery of the two layers, for example, only on the fingertips and cuff. Other varied embodiments that incorporate a liner, a shell, and various floating layers, whether comprised of knitted yarns or moisture barrier films, are also within embodiments according to the invention.

What is claimed is:

1. A flexible, multi-layer glove, comprising, a knitted glove liner, having four fingers and a thumb, further comprising a para-aramid material on a palm side and a backhand side;

a glove shell attached to the knitted glove liner, comprising a knitted meta-aramid layer and an oxidized polyacrylonitrile fabric on a backhand side and a leather material having a flame-resistant treatment on a palm side;

a moisture barrier layer comprising a polyurethane material in the shape of a glove; and a plurality of attachment tabs, wherein the plurality of attachment tabs comprise a polyurethane film disposed on a polyester material that join fingertips and a thumbtip of the four fingers and the thumb of the knitted glove liner and the moisture barrier layer, wherein the moisture barrier layer is a first floating layer and wherein the knitted meta-aramid layer and the oxidized polyacrylonitrile fabric are sewn at a cuff portion and fingertips, wherein a second floating layer is formed and wherein the meta-aramid layer is disposed on an exterior side of the backhand side.

2. The flexible, multi-layer glove of claim 1, wherein the moisture barrier layer comprises a polytetrafluoroethylene material.

3. The flexible, multi-layer glove of claim 2, wherein the moisture barrier layer further comprises a breathable expanded polytetrafluoroethylene membrane.

4. The flexible, multi-layer glove of claim 1, further comprising a second liner adhered or plaited therewith the liner.

5. The flexible, multi-layer glove of claim 1, wherein the glove shell comprises a flame-resistant oxidized polyacrylonitrile yarn on an interior side and a meta-aramid yarn on an exterior side.

6. The flexible, multi-layer glove of claim 1, wherein the liner comprises fibers having at least one yarn including a textured nylon, a nylon wrapped with an elastomeric yarn, nylon 66, a moisture-controlling yarn, a para-aramid, an ultra-high molecular weight polyethylene, a polyester, an aromatic polyester, a steel wire, fiberglass, or any blend of the fibers thereof.

7. The flexible, multi-layer glove of claim 1, wherein the liner is flame-resistant comprising at least one of a meta-aramid yarn, a modacrylic yarn, an oxidized-polyacrylonitrile yarn, or any blend thereof.

8. A flexible, multi-layer glove, comprising, a liner comprising a para-aramid yarn, wherein the liner has a plurality of fingers and a thumb, defining a volume to receive a hand;

a glove shell, comprising:

a backhand side comprising a meta-aramid layer joined to an oxidized-polyacrylonitrile layer, wherein the meta-aramid layer and the oxidized-polyacrylonitrile layer comprise stitches at a cuff portion and at fingertip portions, forming a shell floating layer; and a palm side comprising a leather;

a barrier layer in the shape of a glove, wherein internal attachment tabs are attached to an internal surface of the barrier layer at fingertips and a thumbtip of the barrier layer and wherein external attachment tabs are attached to an external surface of the barrier layer at fingertips and a thumbtip of the barrier layer;

wherein the internal attachment tabs attach the plurality of fingers and the thumb of the barrier layer to the liner, forming a barrier floating layer and wherein the barrier floating layer is disposed between the liner and the glove shell; and wherein the backhand side and the palm side of the glove shell are attached to the external attachment tabs.

9. The flexible, multi-layer glove of claim 8, wherein the liner is a flame-resistant liner comprising at least one of a meta-aramid yarn, a modacrylic yarn, an oxidized-polyacrylonitrile yarn, or any blend thereof.

10. The flexible, multi-layer glove of claim 8, wherein the glove shell further comprises a flame-resistant treated leather.

11. The flexible, multi-layer glove of claim 8, wherein the glove is compliant and/or certified to at least one of NFPA 1971-99, NFPA, 1971-13, NFPA 1999, or NFPA 2012 standards.

12. A method for manufacturing a flexible, multi-layer glove, comprising:

heating a plurality of attachment tabs;

adhering the plurality of attachment tabs to a glove-shaped moisture-barrier layer on a plurality of fingers and fingertips;

sewing the plurality of attachment tabs to a liner;

inverting the moisture-barrier layer onto the liner;

adhering a plurality of attachment tabs to the inverted moisture-barrier layer on the plurality of fingers and fingertips;

attaching the moisture-barrier layer to a glove shell;

inverting the glove shell having the moisture-barrier layer adhered thereon;

moisture-barrier layer to; and heating the liner, the glove shell, and the moisture-barrier layer at a temperature ranging between 110-150° C. to form a flexible, multi-layer glove.

13. The method of claim 12, further comprising a step for applying pressure during the heating the liner, the glove shell, and the moisture-barrier layer step.

14. The method of claim 12, wherein the heating a plurality of attachment tabs is at approximately 140-200° C.

15. The method of claim 12, wherein the glove shell comprises a first meta-aramid fabric and a second oxidized polyacrylonitrile fabric are sewn on less than 50% of its periphery, forming a floating composite layer.

16. A flexible, multi-layer glove of claim 8, wherein at least one of the meta-aramid layer or the oxidized polyacrylonitrile layer is shorter and less wide on finger areas.

* * * * *